US009870712B1

(12) United States Patent
Weichbrod

(10) Patent No.: US 9,870,712 B1
(45) Date of Patent: Jan. 16, 2018

(54) TIME AND SPATIAL BASED FLIGHT SELECTION SYSTEM AND METHOD

(71) Applicant: Rockwell Collins, Inc., Cedar Rapids, IA (US)

(72) Inventor: Shimon Weichbrod, Baltimore, MD (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 65 days.

(21) Appl. No.: 14/741,340

(22) Filed: Jun. 16, 2015

(51) Int. Cl.
*G08G 1/00* (2006.01)
*G08G 5/00* (2006.01)

(52) U.S. Cl.
CPC ..... *G08G 5/0039* (2013.01); *G08G 5/0021* (2013.01); *G08G 5/0047* (2013.01); *G08G 5/0078* (2013.01); *G08G 5/0091* (2013.01)

(58) Field of Classification Search
CPC ... G08B 25/009; H04W 84/18; G08G 5/0039; G08G 5/0013; G08G 5/0021; G08G 5/0034; G08G 5/0052; G08G 5/006; G08G 5/0091; G08G 5/0047; G08G 5/0078; G08G 5/0043; G06Q 10/0635; G05D 1/0204
USPC ..... 701/3–5, 414, 415, 417, 465–467, 532, 701/538; 340/945, 901, 903, 905, 970, 340/973, 995.1; 342/179, 182
See application file for complete search history.

(56) References Cited

U.S. PATENT DOCUMENTS

| | | | | |
|---|---|---|---|---|
| 6,873,269 | B2 * | 3/2005 | Tran | G01C 23/00 340/945 |
| 7,925,393 | B2 | 4/2011 | Bolt, Jr. et al. | |
| 8,843,303 | B1 * | 9/2014 | Young | G08G 5/0039 701/122 |
| 2010/0332122 | A1 | 12/2010 | Weichbrod et al. | |
| 2014/0343765 | A1 * | 11/2014 | Suiter | G08G 5/0056 701/18 |
| 2015/0073695 | A1 * | 3/2015 | Groves | G01W 1/02 701/400 |

* cited by examiner

*Primary Examiner* — Nga X Nguyen
(74) *Attorney, Agent, or Firm* — Angel N. Gerdzhikov; Donna P. Suchy; Daniel M. Barbieri

(57) ABSTRACT

A system and method may provide a real time alternative flight selection based on threat mitigation along a currently planned path at a specific time. The system and method may receive threat information associated with a specific path and compare the threat information to each leg of the path to determine if a threat may exist during that specific leg. Should a threat exist, the method may propose an alternate estimated time of departure (ETD) to mitigate the future threat. Should the alternate ETD be insufficient to mitigate the threat, the method may further propose an alternate lateral and vertical path at the original or modified ETD to successfully mitigate the threat.

21 Claims, 7 Drawing Sheets

TIME AND SPATIAL BASED FLIGHT SELECTION SYSTEM AND METHOD

FIELD OF THE INVENTIVE CONCEPTS

The inventive concepts disclosed herein relate generally to routing of aircraft when an initial planned routing may be hazardous. More particularly, embodiments of the inventive concepts disclosed herein relate to a system and related method selection of an alternate path for a vehicle when the system recognizes the planned path may be threatened.

BACKGROUND

There are many services that provide alerts to pilots warning them of potential threats, whether it is related to weather, Air Traffic Control (ATC) restrictions or navigational (GPS) impairments. The traditional solution may be typically an attempt at an alternate path to bypass these threats.

Many air carriers provide each flight crew with an alternate path of flight to mitigate an enroute (e.g., weather related) threat. These standard weather avoidance procedures (SWAP) routes may enable an aircrew to make accurate decisions based on a current fuel load and preplanned alternate routing from a departure airport to a destination. These traditional weather providers may retrieve weather alerts for specifically provided routes. However, their logic is limited to monitoring a provided route and is limited to specific times.

Further, additional threats may impact the timeliness and fuel burn of a specific flight. For example, an outage or a reduction in accuracy of a particular navigational aid including a Global Navigation Satellite System (GNSS) may impact an ability of a flight or aircraft to successfully navigate a particular route.

Further, a mechanical anomaly or Minimum Equipment List (MEL) item onboard the aircraft reducing an accuracy of navigational equipment may impact an ability of the aircraft to successfully maintain an accuracy required within a particular airspace. For example, a Required Navigation Performance (RNP) accuracy requirement of RNP4 may be required to enter a specific oceanic track. Should an aircraft be unable to maintain the designated accuracy requirement, the flight may be forced to divert or hold until minimum separation may be manually assured.

In addition, route changes are dependent on ATC, which during a large weather event may cause crowded airspace and may limit the availability of the requested route. For flights traversing through multiple countries, altering the route to avoid a threat may increase the cost of the flight by crossing additional countries, or may be inhibited because the correct permits were not obtained, or the country may be unsafe and/or illegal to cross.

Coupled with perishable SWAP route decisions and limited decisions made by ATC, the traditional weather alerts may lead decision makers to select an alternate route for the flight which may not be the most efficient route in terms of time and fuel. Since alternate routes typically have the negative impact in time, fuel costs and additional wear on the aircraft, a need remains for selecting an alternate path for the flight which may use a time and altitude window to continuously and automatically propose an alternative path.

SUMMARY

In one aspect, embodiments of the inventive concepts disclosed herein are directed to a system for alternate threat based path selection. The system may comprise a processor, a non-transitory processor-readable memory operatively connected with the processor and storing processor-executable code, a Flight Management System (FMS) interface operatively connected with the processor and configured for receiving an alternate path selection from the processor and configuring the alternate path selection to be recognizable by a FMS, wherein The processor may be configured for receiving threat information associated with a planned path at a specific time, the threat information including a threat, the threat including a threat time and a threat boundary for the threat, receiving the planned path including one or more legs, the planned path from a departure to a destination for a vehicle, each leg of the one or more legs associated with two or more waypoints, each waypoint a lateral point on the planned path, the planned path may further include a planned altitude for each leg.

The processor may further receive the threat information associated with the planned path at the specific time, determine an estimated time of arrival (ETA) for each waypoint on the planned path, compare the threat time to the ETA, and comparing the threat boundary to each leg of the one or more legs. The processor may further determine an alternate path for a leg of the one or more legs based on the comparing, display the alternate path to an operator of the vehicle on a display, receive an alternate path selection from the operator, and transmit the alternate path selection to the FMS interface.

In a further aspect, embodiments of the inventive concepts disclosed herein are directed to a system wherein the planned altitude for each leg further includes one of: a mean sea level (MSL) altitude, an above ground level (AGL) altitude, a MSL altitude of zero for an entirety of the planned path, an average AGL altitude of zero for the planned path, and an average depth below an ocean surface.

In a further aspect, embodiments of the inventive concepts disclosed herein are directed to a system wherein the threat may further comprise a weather related threat, an airspace related threat, a traffic related threat, an operational related threat and a hostile threat to the vehicle.

In a further aspect, embodiments of the inventive concepts disclosed herein are directed to a system wherein the FMS interface is further configured for receiving the alternate path selection and formatting the alternate path selection to be readable by a path management system in current operation on the vehicle.

In a further aspect, embodiments of the inventive concepts disclosed herein are directed to a system incorporated within an architecture of an aircraft FMS, a dispatch planning system, and a tactical mission planning system, and wherein the threat time for the threat further includes a start time and an end time for the threat and the threat boundary further includes a vertical boundary and a horizontal boundary for the threat.

In a further aspect, embodiments of the inventive concepts disclosed herein are directed to a system wherein the FMS interface is further configured for sending the alternate path selection to a remote vehicle via a data link, and wherein comparing the threat time to the ETA, and comparing the threat boundary to each leg of the one or more legs further includes a per leg comparison of the threat to the planned path.

In a further aspect, embodiments of the inventive concepts disclosed herein are directed to a system wherein determining the alternate path further includes 1) an alternate ETA outside the threat time for each of the waypoints, 2) an alternate lateral path outside the threat boundary, 3) an alternate vertical path outside the threat boundary, and 4) and alternate destination for the vehicle, each of the alternate ETA, the alternate lateral path and the alternate vertical path 1) mitigates the threat and 2) creates a minimum distance path from the departure to the destination.

In a further aspect, embodiments of the inventive concepts disclosed herein are directed to a system wherein the operator of the vehicle is one of: onboard the vehicle and in control of the vehicle, and offboard the vehicle and in remote control of the vehicle.

In a further aspect, embodiments of the inventive concepts disclosed herein are directed to a method for alternate threat based path selection. The method may comprise receiving threat information within a threat information module, the threat information associated with a planned path at a specific time, the threat information including a threat, the threat including a threat time and a threat boundary.

The threat information module may be associated with a processor, a non-transitory processor-readable memory operatively connected with the processor and storing processor-executable code, and a Flight Management System (FMS) interface, The method may receive the planned path for a vehicle including one or more legs, the planned path from a departure to a destination for the vehicle, each leg of the one or more legs associated with two or more waypoints, each waypoint a lateral point on the planned path, the planned path further including a planned altitude for each leg, determining an estimated time of arrival (ETA) for each waypoint on the planned path, comparing the threat time to the ETA, and comparing the threat boundary to each leg of the one or more legs.

The method may further determine an alternate path for a leg of the one or more legs based on the comparing, the determining via an alternate path selection module, display the alternate path to an operator of the vehicle on a display, receive an alternate path selection from the operator, configure the alternate path selection to be recognizable by a FMS via the FMS interface, and transmit the alternate path selection to a FMS onboard the vehicle.

It is to be understood that both the foregoing general description and the following detailed description are exemplary and explanatory only and are not necessarily restrictive of the inventive concepts disclosed and claimed herein. The accompanying drawings, which are incorporated in and constitute a part of the specification, illustrate embodiments of the inventive concepts disclosed herein and together with the general description, serve to explain the principles of the inventive concepts disclosed herein.

BRIEF DESCRIPTION OF THE DRAWINGS

The numerous advantages of the inventive concepts disclosed herein may be better understood by those skilled in the art by reference to the accompanying figures in which.

DETAILED DESCRIPTION

Reference will now be made in detail to the presently preferred embodiments of the inventive concepts disclosed herein, examples of which are illustrated in the accompanying drawings.

The following description presents certain exemplary embodiments of the inventive concepts disclosed herein. However, the inventive concepts disclosed herein may be embodied in a multitude of different ways as defined and covered by the claims. In this description, reference is made to the drawings wherein like parts are designated with like numerals throughout.

The inventive concepts disclosed herein may operate to provide a pilot and/or dispatcher a real time alternative path selection based on threat mitigation along a currently planned path at a specific time. The system and method may receive threat information associated with a planned path (e.g., a flight plan (air navigation) and a passage plan (marine navigation)) and compare the threat information to each leg of the path to determine if a threat may exist during that specific leg. Should a threat exist, the method may propose an alternate time of departure to mitigate the threat. Should the alternate time of departure be insufficient to mitigate the threat, the method may further propose an alternate lateral and vertical path at an original or modified Estimated Time of Departure (ETD) to successfully mitigate the threat.

Although portions of this disclosure may relate specifically to an aircraft as the vehicle for which embodiments of the inventive concepts disclosed herein may provide one function, additional vehicle types may also be directly applicable to alternate path selection disclosed herein. Skilled artisans will recognize the inventive concepts disclosed herein may directly apply to any vehicle for which a path and estimated time of departure may be planned.

REFERENCE CHART

No. Description
100 System for Flight Selection
102 Vehicle
110 Alternate Path Selection Module
112 Processor
114 FMS Interface
116 Memory
118 Updates
120 Flight Management System (FMS)
122 Input Output
124 Display
128 Source
130 Threat Information Module
132 Weather Threats
134 Airspace Threats
136 Traffic Threats

Figure 1:
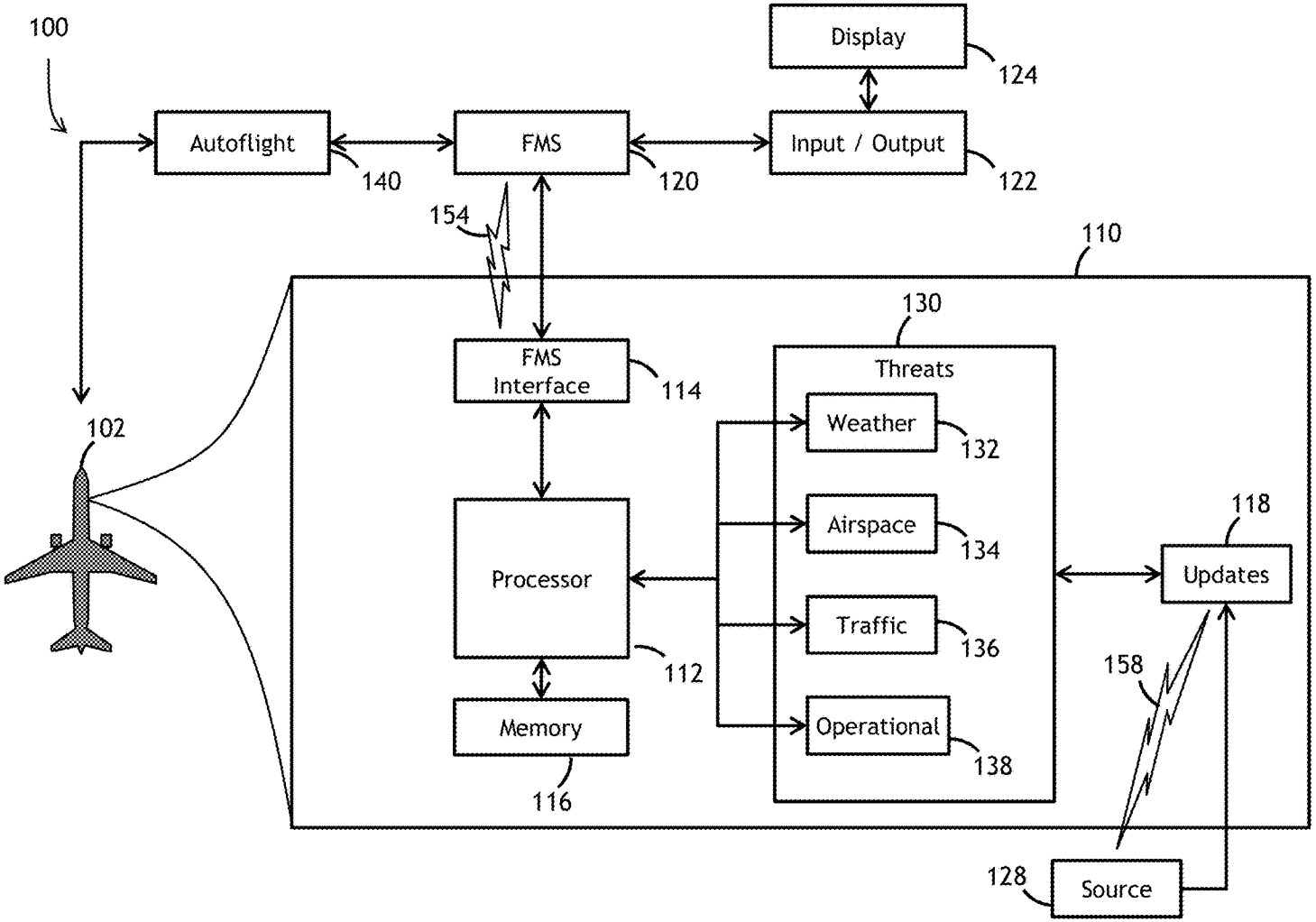
FIG. 1 is an exemplary system for time and spatial based flight selection provided by one embodiment of the inventive concepts disclosed herein.

138 Operational Threats
140 Autoflight
154 FMS Wireless Data Connection
158 Source Wireless Data Connection
200 Alternate System for Flight Selection
222 Flight Management Computer
300 Method Flowchart
302 Receive Save Path
304 Determine ETA per Leg
306 Receive Save Threat Information
308 Compare ETA to Threats
310 Determine threat for each leg of path
312 Threat to flight on a leg
314 Mitigate threat via delay or accelerate?
316 Determine Alternate ETD
318 Propose Alternate ETD
320 Receive & save pilot selected ETD
322 Transmit selected ETD to FMS
324 Update Threat information
330 Determine alternate path
332 Propose Alternate Path
334 Receive & save pilot selected path
336 Transmit selected Alternate Path to FMS
338 Update
400 Altitude Threat Matrix
410 DBQ Threat
420 MARLY Threat
430 SNY Threat
440 FROGS Threat
500 Temporal Threat Matrix
600 Path Chart
602 Ground Based Vehicle
610 Planned Path
612 Great Circle Path
614 Alternate Path
616 Alternate Ground Based Path
702 Ship
704 Submarine
710 Great Circle Path
712 Alternate Oceanic Path
720 Typhoon
730 Departure
732 Destination
734 Alternate Destination Referring to FIG. 1, an exemplary system for time and spatial based flight selection provided by one embodiment of the inventive concepts disclosed herein is shown. A system 100 for time and spatial based flight selection onboard a vehicle 102 (e.g., aircraft) may include an alternate path selection module 110, a processor 112 configured for executing a variety of processes associated with the system 100, a memory 116, a Flight Management System (FMS) interface 114, an update system 118, and a threat information module 130. In direct communication with the alternate path selection module 110, a FMS 120 is operationally tasked with management of the horizontal path and vertical path of the vehicle 102. Although the vehicle 102 is shown as an aircraft, in some embodiments the system 100 may be implemented with any vehicle or platform, including unmanned aerial vehicles, terrestrial vehicles, marine or submarine vehicles, space vehicles, or combinations thereof.

The processor 112 may execute non-transitory computer readable program code stored within the memory 116 to carry out the function of the alternate path selection module 110. The memory 116 may operate to store the computer readable program code as well as each parameter associated with the operation of the alternate path selection module 110 and/or data. For example, some parameters the memory 116 may store include threats from the threat information module 130 and updates 118 to the threats received from an external source 128 of threat information. Exemplary threats 130 may include weather threats 132, airspace threats 134, traffic threats 134 and operational threats 136.

As used herein, a threat may be defined as any hindrance to a desired ETA at a specific waypoint. For example, a threat may be a weather threat 132 causing an aircraft to deviate around the weather threat 132 to ensure a safe and turbulent free flight from a first waypoint to a second waypoint. An additional threat may include an airspace threat 134. For example, a Military Operations Area (MOA) may be active for a portion of a scheduled flight requiring the aircraft to circumvent the MOA at increased cost in time and fuel. However, if the flight may depart at an alternate time generated by the system 100, the flight may be able to traverse through the MOA during a time when the MOA is inactive. An exemplary airspace threat 134 may be geographically indicated on a chart, and may require a valid time when the airspace may be active and an altitude descriptor should the airspace be less than fully active. For example, the Lake Andes MOA may active from 1200Z to 1500Z from FL180 to FL500.

In addition, each threat may also be identified with a level of the threat. The system 100 may analyze multiple levels of each threat and, based on the threat level analysis, offer the alternate path to the crewmember based on mitigating the most severe level of the threat. For example, once threat may include a "Warning Level" as well as a "Critical Level" of a specific threat. The alternate path selection module may analyze the levels of the threats and provide an alternate path to mitigate the threats identified as critical. For example, the system 100 may display to a crewmember each level of each threat and allow the crewmember to avoid all turbulence or only avoid severe turbulence.

Also, an exemplary threat may be a traffic threat 136 including a runway closure at a specific time which may cause a traffic backup leading to increased fuel burn and time enroute. Embodiments of the inventive concepts disclosed herein may operate to mitigate the traffic threat 136 via a generation and presentation to the flight crew of an earlier and/or later time of departure to, for example, depart 30 minutes earlier to arrive before the runway is scheduled to close. Further, operational threats 138 may include threats internal to an operation. For example, a major airline may experience a limitation on gate, landing slot or parking space availability at a specific airport. Airports with high traffic and few facilities may present an operational threat 138 to a particular air carrier. Embodiments of the inventive concepts disclosed herein may operate to mitigate the operational threats 138 through identifying the operational threat 138 and offering an alternate path which removes the operational threat 138 from the selected path.

Each threat may include a threat time and a threat boundary. A weather threat 132 may include a vertical boundary coupled with a lateral boundary. For example, a weather threat 132 warning of mountain wave turbulence from FL280 to FL340 within a geographic area bounded by a set of four latitude longitudes. The mountain wave weather threat 136 may also have additional descriptors such as a threat time of an exemplary 0300Z to 1000Z and a level of the threat (e.g., severe turbulence).

A non-exclusive list of potential threats to a path may include a weather related threat such as thunderstorm activity and lightning, an airspace related threat including restricted areas and prohibited areas (e.g., Significant Meteorological Condition) SIGMET Airborne Meteorological Condition (AIRMET)), a geographical related threat including a volcanic eruption, forecast runway (Notice to Airman (NOTAM), seaway, Notice to Mariner (NtM)) and road (department of roads) closure and additional temporary physical threats. An additional threat may include a weapons related threat to the aircraft including a surface to air weapons engagement zone and a terroristic threat to the aircraft.

For example, a specific airport may be expecting a Presidential transit at some point during a day. This information is kept confidential for a period before the transit, and may adversely impact an inbound flight since an entire airport may temporarily close during the transit. Embodiments of a system 100 according to the inventive concepts disclosed herein may operate to receive the Presidential transit information from the appropriate authorities as soon as the information is available and offer an earlier departure to the flight crew to arrive before the Presidential transit.

The FMS interface 114 may provide alternate path information from the alternate path selection module 110 to the FMS 120 in a format recognizable by the FMS 120. For example, the system 100 may be operationally installed within the avionics of a vehicle 102 such as an aircraft currently usable in service. In this situation, the alternate path selection module 110 may operate as a peripheral module and supply the FMS 120 with data recognizable by the FMS 120. Further, the FMS 120 may receive the benefits of the information supplied by the alternate path selection module 110 without an expensive and time consuming software or hardware modification.

Additionally, the alternate path selection module 110 may address performance capabilities of the vehicle to ensure the vehicle may comply with the alternate path. For example, an aircraft maximum altitude capability and/or a regulatory limitation (e.g., Reduced Vertical Separation Minimum (RVSM), Reduced Navigation Performance (RNP), etc.).

In a further embodiment, the alternate path selection module 110 may reside within a Portable Electronic Device (PED) carried onboard the vehicle and configured for interfacing with the FMS via the FMS interface 114. The FMS interface 114 may be further configured for wireless connectivity to enable direct wireless communication between the FMS interface 114 and the FMS. In addition, a FMS wireless data connection 154 may operate to wirelessly connect the FMS interface 114 with the FMS 120. In this manner, the alternate path selection module 110 may reside external to the FMS 120 should the FMS 120 be installed within the vehicle 102. Once the crewmember may select a new path via the input/output 122, the FMS may transmit the newly selected path to the PED for further processing and crewmember use.

Once the FMS 120 receives the alternate path information, the FMS 120 may display the alternate path information to a crewmember on a display 124. The crewmember may select a desired path from the alternate path information via the input output 122 to enter the desired path as a selected path. The display 124 may be one device with which the system 100 may communicate with and receive input from a crewmember. The FMS 120 may operate to send command signals to the autoflight systems 130 to maneuver the vehicle 102 according to the alternate path selection.

In additional embodiments, the alternate path selection module 110 may reside offboard the vehicle 102 within a mission planning or dispatch planning station. The offboard system 100 may generate the alternate path information based on the threats compared with the currently selected path and transmit the alternate path information via datalink or additional transmission methods to the FMS for onboard browsing and selection by the crewmember.

In addition, the source 128 may provide updated threat information via a plurality of connectivity capabilities configured within the alternate path selection module 110. For example, a source wireless data connection 158 transfer from the source 128 to the alternate path selection module 110 may offer updated threat information to the system 100. Additionally, ground services (e.g., via Aircraft Communications Addressing and Reporting System (ACARS) and/or high speed data) may offer capabilities similar to those found in the FMS 120.

Figure 2:
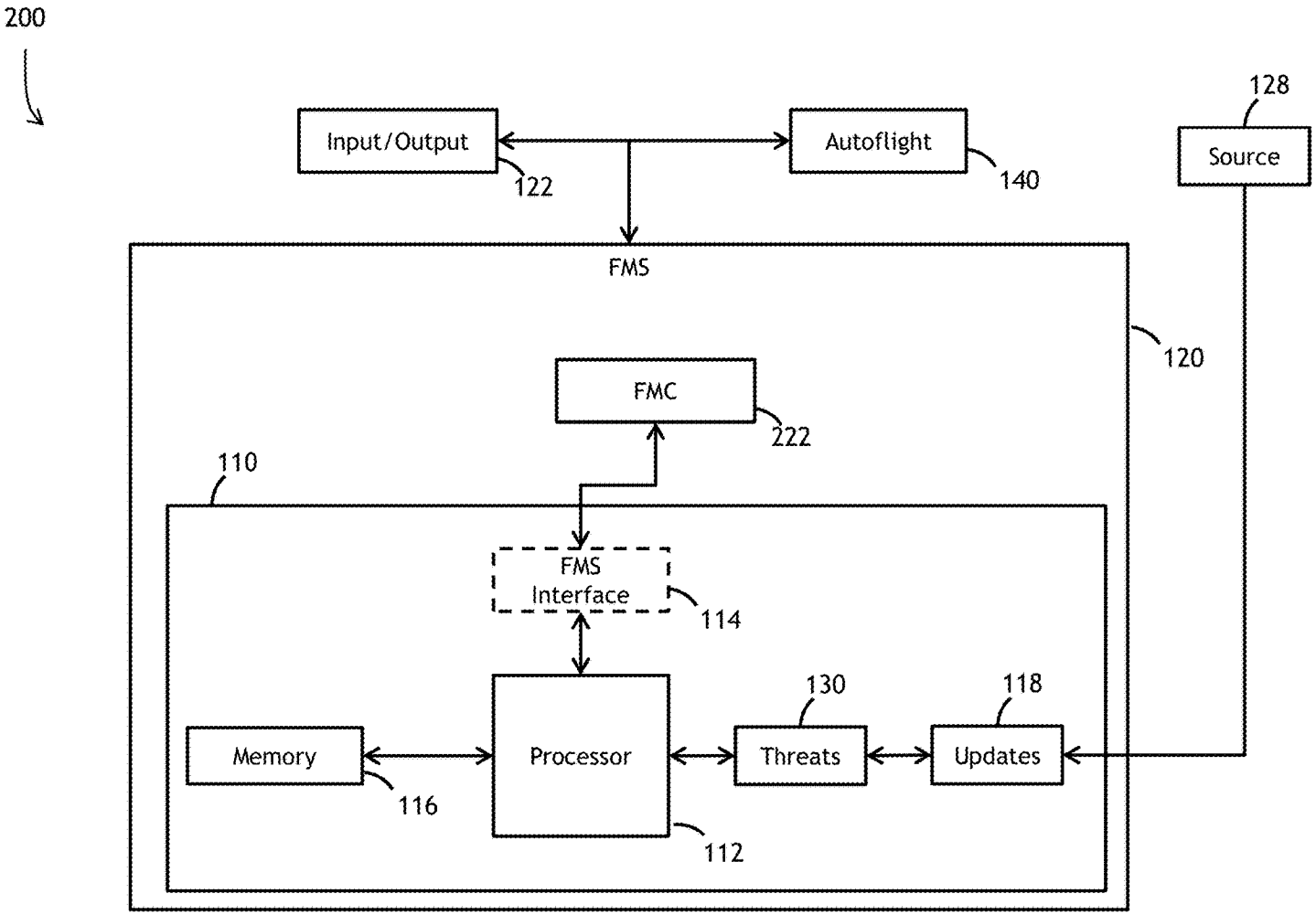
FIG. 2 is an exemplary alternate embodiment of a system for time and spatial based flight selection provided by one embodiment of the inventive concepts disclosed herein.

Referring to FIG. 2, an exemplary embodiment of an integrated system 200 for time and spatial based flight selection provided by one embodiment of the inventive concepts disclosed herein is shown. The integrated system 200 may include an integrated alternate path selection module 110 onboard a vehicle such as the vehicle 102 (aircraft) within a FMS 120 architecture. Here, an optional FMS interface 114 may directly interact with a Flight Management Computer (FMC) 222 to enable the FMS 120 the additional capability found within the alternate path selection module 110.

The integrated system 200 may be available to a FMS manufacturer during initial FMS construction, during an FMS upgrade, or during a routine FMS update. In this manner, the FMS 120 may receive input from a pilot via the input output 122 and the alternate path selection module 110 may operate in the background to continuously update 118 the threat information 130 and compare the planned path with the threat information to determine the alternate path information. In addition, the alternate path selection module 110 may operate in the background to intermittently, periodically, in real-time, or near real-time update the threat information 130.

For example, in the United States, a filed flight plan may remain active within an Air Traffic Control (ATC) database from approximately 30 minutes prior to the ETD and until two hours after the ETD. Should an aircrew choose an alternate path offering a departure earlier or later based on the alternate path information, they may expeditiously depart without a requirement to file a new flight plan.

Similarly, once underway, the aircrew may normally request a new altitude via ATC without requiring a new flight plan filing. Should the integrated system 200 determine a threat may be present at a current altitude, the integrated system 200 may offer an alternate path to the aircrew to 1) select an alternate vertical path 2) select an alternate lateral path, and 3) select an alternate ETA at a specific waypoint to eliminate the threat 130.

In one embodiment, each of the system 100 and the integrated system 200 may actively transmit a request for specific threats at specific times along a planned and alternate selected path. For example, a transmission from the integrated system 200 may request all Temporary Flight Restrictions (TFR) via the offboard source 128 along a specific path. Once received, the integrated system 200 may use the received threat information (e.g., airspace threat 134) to generate an alternate path based on elimination of the TFR airspace threat 134. This action may allow the aircrew to make an alternate path selection to mitigate the airspace threat 134.

Figure 3:
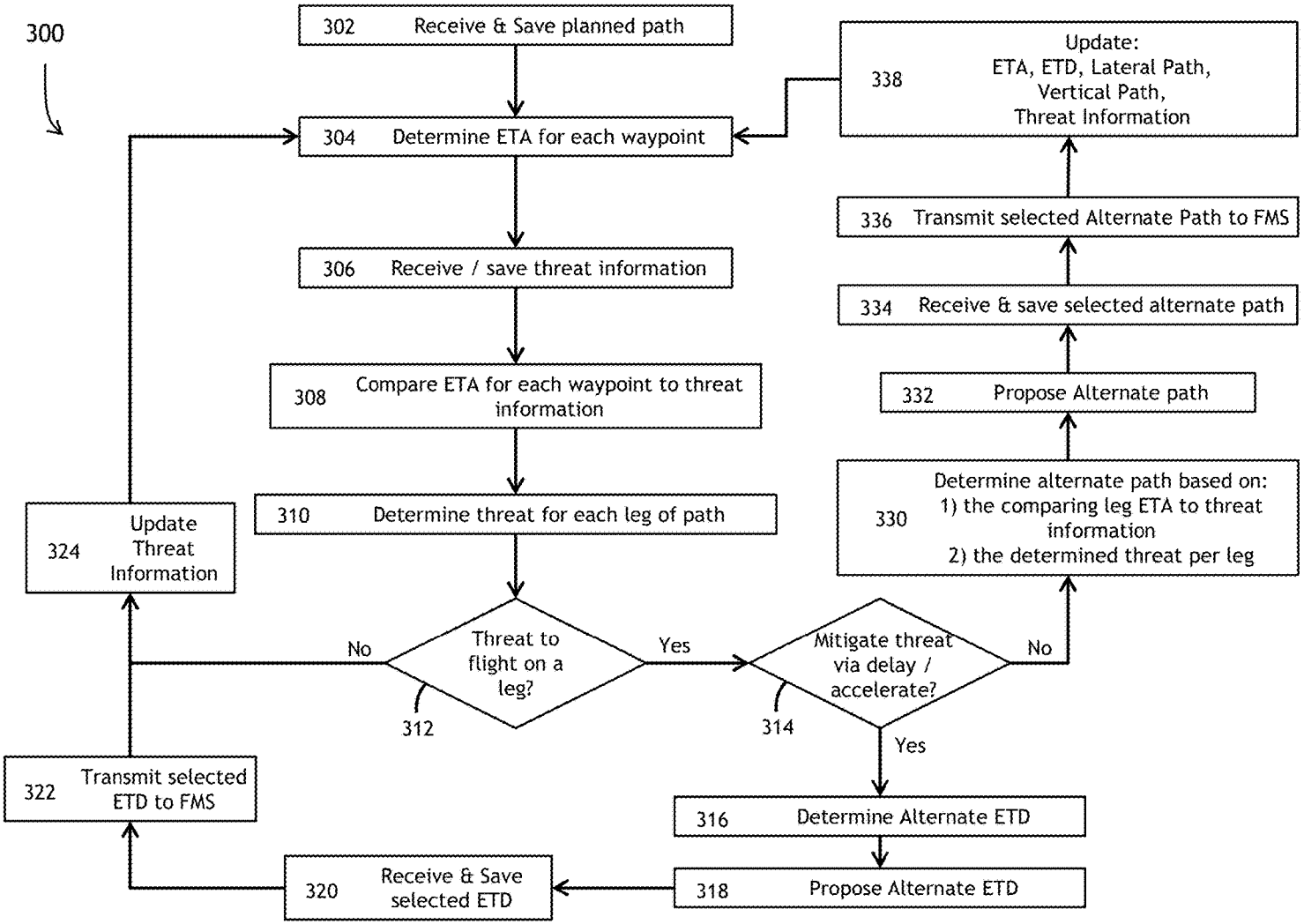
FIG. 3 is a flowchart for time and spatial based flight selection in accordance with one embodiment of the inventive concepts disclosed herein.

Referring to FIG. 3, a flowchart for time and spatial based flight selection in accordance with one embodiment of the inventive concepts disclosed herein is shown. Method flow 300 may begin at a step 302 with receiving and saving a selected path. The selected path may include an ETD from the departure a lateral path along specific waypoints, and a selected altitude. The selected path may include one or more legs between departure and destination as well as a planned altitude speed, and a plurality of waypoints defining the lateral path.

The selected path may be selected by a crewmember, directed by a higher authority and/or received via a transmission from a dispatcher. The method 300 may receive a selected path in one of many ways. For example, a selected path may be received via the input output 122, via a datalink directly to the FMS 120 and via an automatic loading from a data storage device carried by a crewmember.

The method 300 may determine an ETA for each waypoint along the path at a step 304. Each waypoint on the path may be defined as a point over which the vehicle 102 may traverse on the way from departure to destination. A leg may be defined as a distance between two waypoints, the distance shorter than the entire path.

A step 306 may receive and save threat information for each leg of the path. A step 308 may include comparing the ETA at each waypoint to the threat information concerning that leg and, a step 310 may include determining a threat for each leg of the path based on the comparison. A step 312 may include determining whether there is a threat to the flight on a leg. Should the answer to query 312 be negative, the method 300 may update threat information at a step 322 and return to the step 306 to save the updated threat information. Should the result of the query 312 be affirmative, the method 300 may determine at a step 314 to determine if the threat may be mitigated with an acceleration or a deceleration of the ETD.

The query 312 may operate as a comparison of the threat to the selected path. For example, the threat information may include a traffic related threat 136 on the $10^{th}$ leg of the flight between departure and destination. If there is a threat to the vehicle on the $10^{th}$ leg, the system 100 may propose an earlier or later departure to mitigate the threat.

Should the answer to query 314 be affirmative, the method 300 may, at a step 316, determine an alternate ETD based on the threat information compared to the waypoint ETAs. The method 300 may proceed to a step 318 of proposing the alternate ETD to the crewmember via the display 124. The method 300 may receive and save the crew selected ETD at a step 320, may transmit the newly selected ETD to the FMS at a step 320 for operational processing, update the threat information at the step 324, and return to the step 304 to update ETAs per each waypoint.

However, should the answer to the query 314 be negative, the method 300 may, at a step 330, determine an alternate path based on: 1) the comparing leg ETA to threat information and 2) the determined threat per leg. The method may analyze possible leg combinations to create a best possible path made up of one or more non-threat legs. The method 300 may propose the alternate path to the crewmember at a step 332 and receive and save the crew selected path at a step 334. The method 300 may transmit the updated alternate path selection to the FMS at a step 336, and update each of the ETA, ETD, lateral and vertical paths and threat information at a step 338, and return to the step 304 to update the ETA for each waypoint on the selected alternate path.

Figure 4:
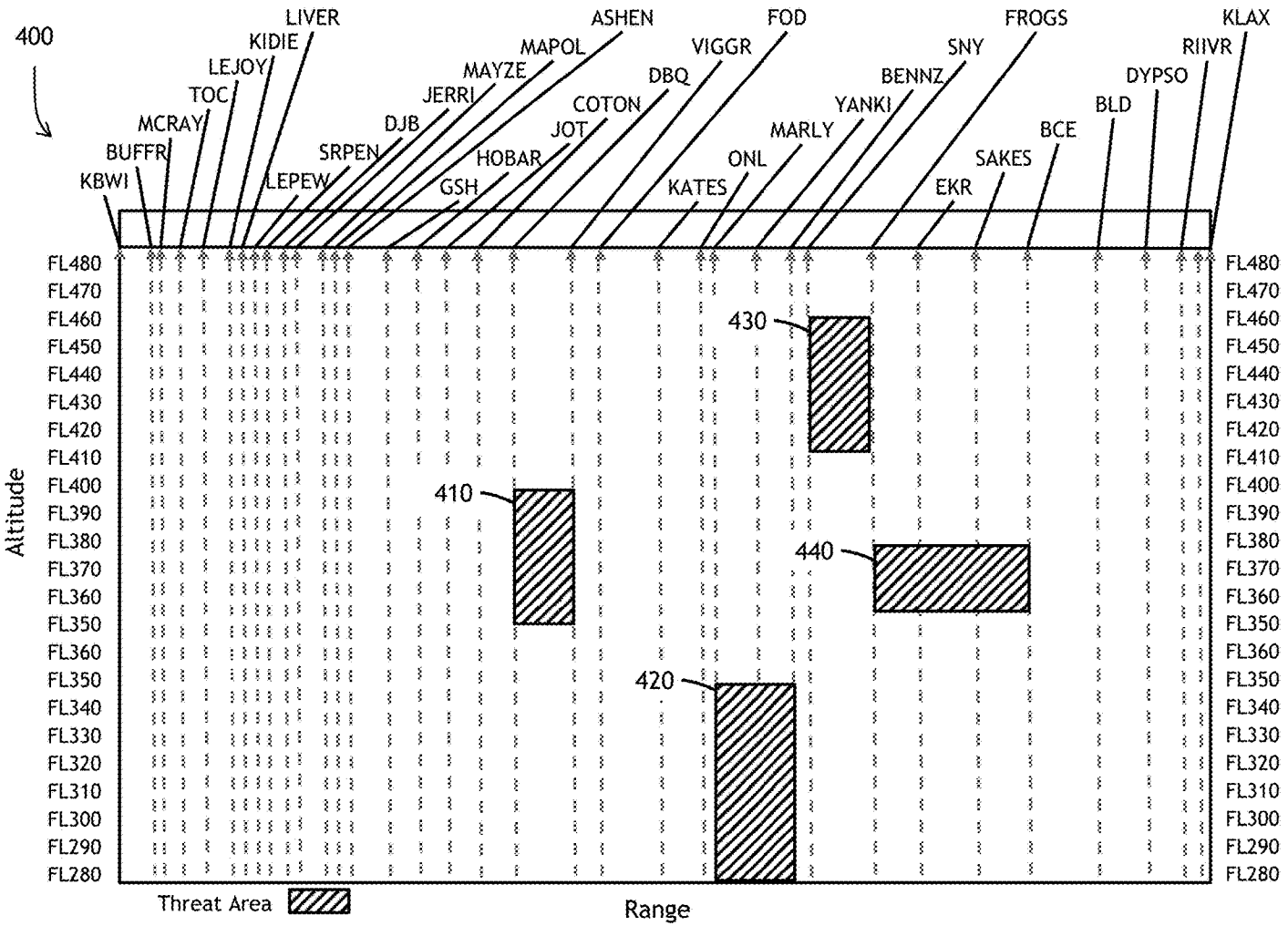
FIG. 4 is an exemplary altitude threat matrix usable by time threat matrix usable by one embodiment of the inventive concepts disclosed herein.

Referring to FIG. 4, an exemplary altitude threat matrix 400 usable by one embodiment of the inventive concepts disclosed herein is shown. The altitude threat matrix 400 showing altitude on the y axis and range on the x axis may indicate possible threats and locations of the threats relative to each of the waypoints on the path. An exemplary path for an aircraft embodiment of the vehicle 102 from Baltimore Washington International Airport (KBWI) to Los Angeles International Airport (KLAX) may include a plurality of legs between a corresponding plurality of waypoints. For example, after departure from KBWI, the aircraft may traverse BUFFR, MCRAY and LEJOY and eventually RIIVR on the way to KLAX. A first leg of the path may operate from KBWI to BUFFR while a second leg of the path may operate between BUFFR and MCRAY. The system 100 may calculate an ETA for each of the waypoints along the path and compare the threat information to the ETA on a per leg comparison basis.

For example, a selected path from KBWI to KLAX may include the plurality of legs including legs from VIGGR waypoint to FOD Very High Frequency Omnidirectional Range (VOR), and from YANKI intersection to BENNZ intersection. As indicated in the matrix 400, a DBQ threat 410 may exist between the DBQ VOR and the VIGGR waypoint. However, the DBQ threat 410 may be limited by altitude. Here, the DBQ threat is exemplarily indicated at an altitude from 36,000 feet mean sea level Flight Level (FL) 360 to FL 400. In order to avoid the DBQ threat, the vehicle 102 may need to plan to deviate from the original flight plan 1) earlier or later than planned, 2) above or below the threat altitudes (e.g., fly at FL420) and 3) laterally around the DBQ threat 410.

In some instances, threats such as the MARLY threat 420 may extend from the surface of the earth to the indicated FL340. In this case, an aircraft vehicle 102 with limited performance may not be able to climb above the MARLY threat 420. Here the aircraft vehicle 102 with limited performance may be limited to the earlier or later departure or a lateral alternate flight path to mitigate the MARLY threat 420. Similarly, the SNY threat 430 may be at a higher altitude than may be a concern for many vehicles 102 considering a path through the SNY threat 430 area. In this case, the vehicles 102 may remain clear of the SNY threat 430 on their initially selected flight path.

The threats evaluated by the system 100 may span more than two waypoints posing an additional obstacle threat to the vehicle 102. The FROGS threat 440 may extend from the FROGS waypoint through the EKR VOR, through the SAKES waypoint, to the BCE VOR. As the FROGS threat 440 may be limited in altitude coverage, many aircraft may have the performance to maneuver vertically and amend the vertical path to remain clear of the FROGS threat 440. Each possible matrix 400 may be scalable to include a greater and lesser number of waypoints and greater and lesser number of altitudes.

Figure 5:
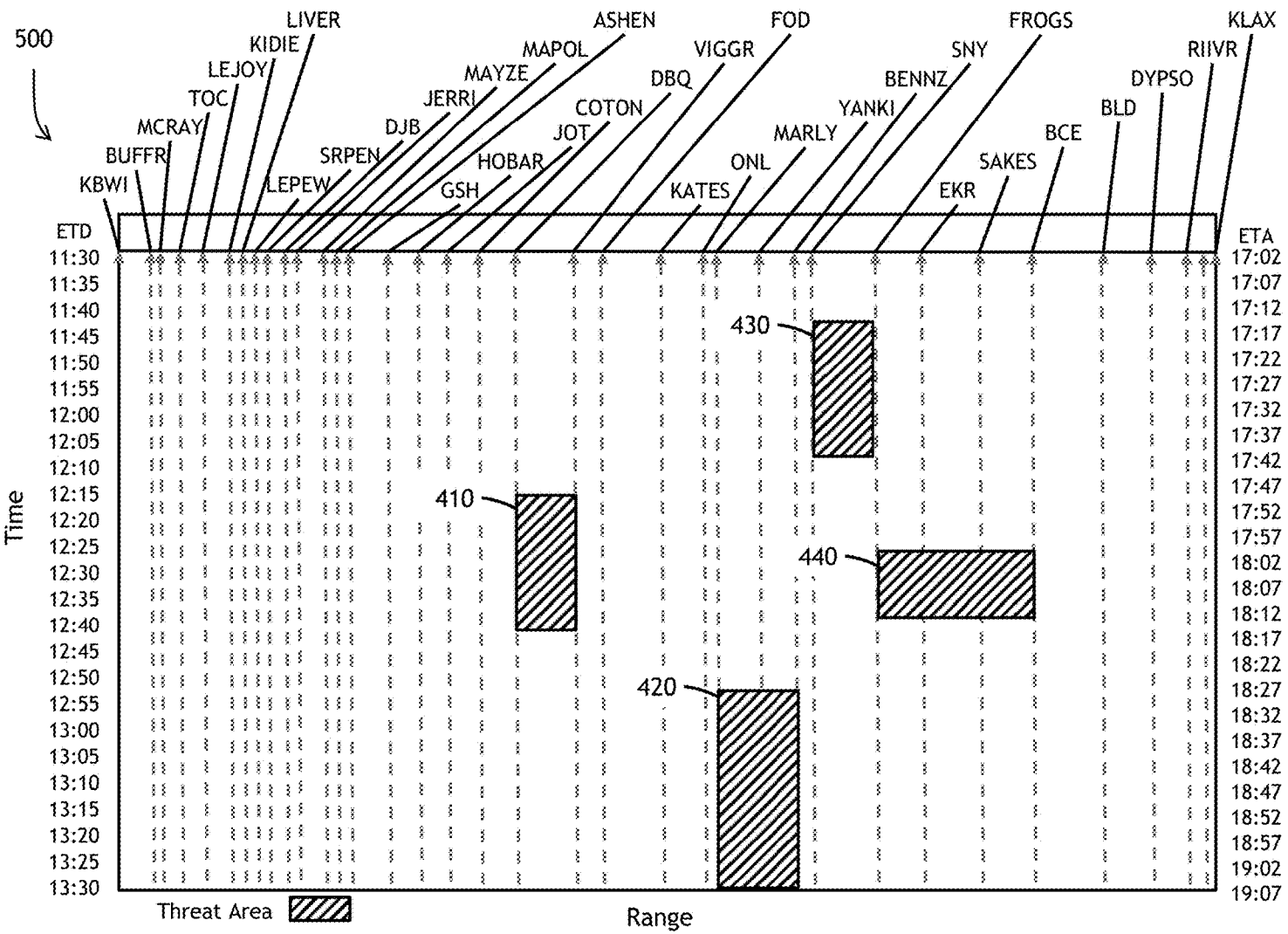
FIG. 5 is an exemplary temporal threat matrix usable by one embodiment of the inventive concepts disclosed herein.

Referring to FIG. 5, an exemplary temporal threat matrix usable by one embodiment of the inventive concepts disclosed herein is shown. The temporal threat matrix 500 may indicate to the crewmember possible times of threat free passage from the departure to the destination. Here, each of the threats may occur in similar locations as in the altitude based threat matrix 400. However, the temporal based threat matrix 500 may offer the crewmember a valuable tool for departure planning to remain clear of threats solely with a variance in departure time. For example, should the vehicle 102 maintain an exemplary scheduled departure time of 1230, the vehicle 102 may encounter both the DBQ threat 410 as well as the FROGS threat 440. However, if the vehicle 102 were to accelerate the departure to an exemplary 1210 or delay the departure to an exemplary 1250, the system 100 may offer a crewmember the option to mitigate each of the DBQ threat 410 and the FROGS threat 440 via the alternate path.

Once the comparison is complete, the system 100 may parse the data associated with selected path for a pre-defined window in time (e.g. one hour prior to ETD and 2 hours after the ETD in five minute increments), and further adjusted for altitudes (10 altitudes above and below selected cruise altitude in 1,000 foot (FL010) increments). In one embodiments of the inventive concepts disclosed herein the system 100 may display to a crewmember the possible threat free altitudes for the path from KBWI to KLAX.

For example, the altitude scale in FIG. 4 is from FL280 to FL480 indicating an exemplary 20,000 feet (10 flight levels above and below the planned altitude). Also, the time scale in FIG. 5 may indicate a target time of 12:30 displaying an exemplary one hour before (11:30) and one hour after (13:30) for possible crewmember selection. In operation, the crewmember may manipulate the departure time and then switch to an altitude view to further analyze if the alternate path may be acceptable. Also, the crewmember may manipulate the altitude and then view the alternate path times for acceptability. Alternately, the system 100 may analyze each of the times and altitudes and select a (ordered) list of viable solutions from which the crewmember may choose.

Figure 6:
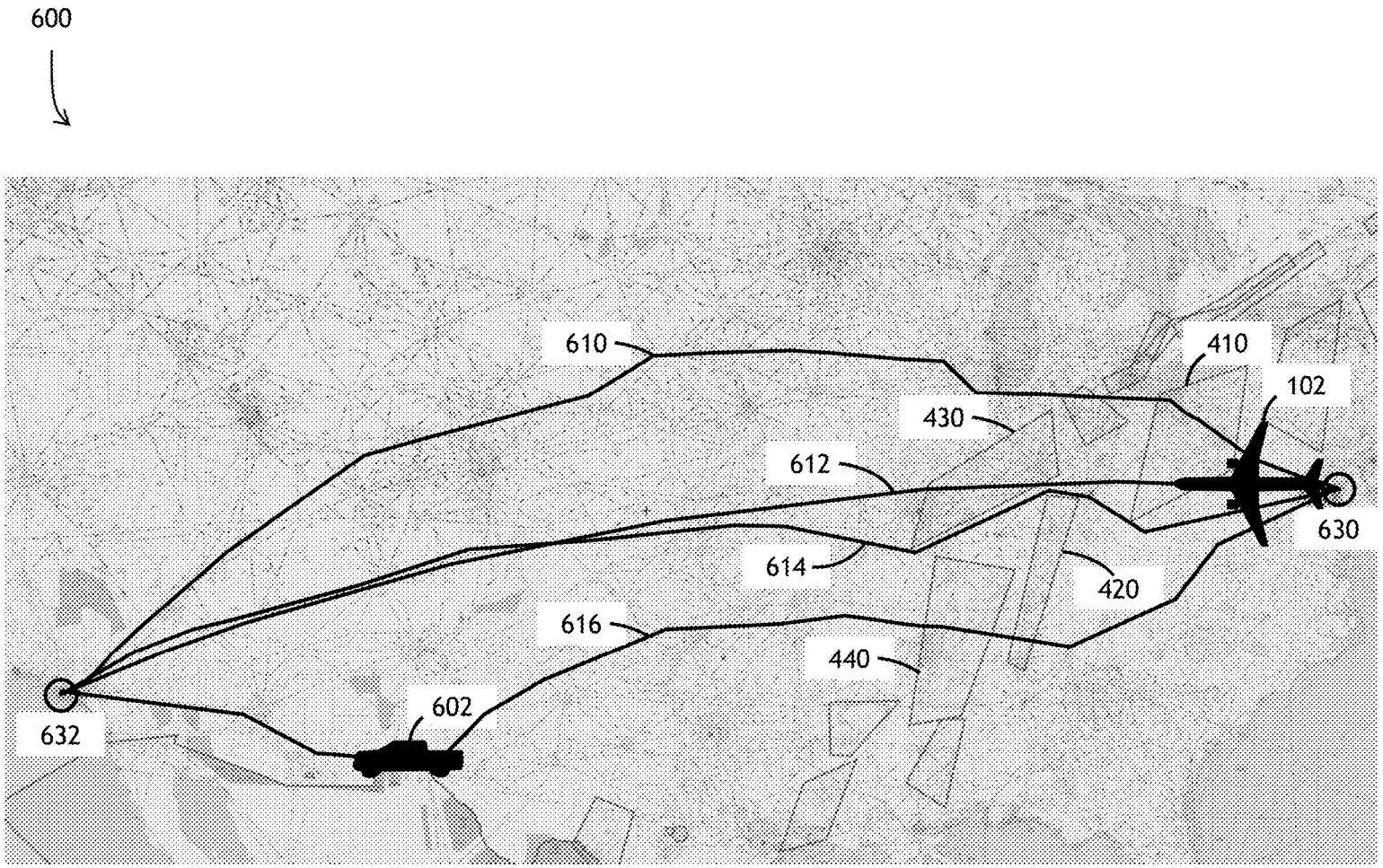
FIG. 6 is an overview of possible terrestrial paths made available by one embodiment of the inventive concepts disclosed herein.

Referring to FIG. 6, an overview of possible terrestrial paths made available by one embodiment of the inventive concepts disclosed herein is shown. Possible path diagram 600 may detail three exemplary paths including an initial path 610, a great circle path 612, an alternate path 614, and an alternate ground based path 616. The shortest distance between the departure and destination (here KBWI 630 and KLAX 632) may be the great circle path 610. However, certain constraints (e.g., departure procedures, arrival procedures, airway dependency) on the path selection may impede flying a perfect great circle path. An initial path 610 may account for many of these constraints but fail to keep the vehicle 102 clear of each threat (e.g., traffic threat 134) within the threat information.

Also a ground based vehicle 602 limited to road travel may be limited to an alternate ground based path 616 based on the available roads for the ground based vehicle 602 to traverse. The system 100 may generate and present the crewmember an alternate path 614 to remain clear of each of the threats 410-440 along the alternate path 614. The alternate path 614 may be longer in length and may require more fuel, but the threat clearance may outweigh the cost of an increased time and increased fuel burn.

Figure 7:
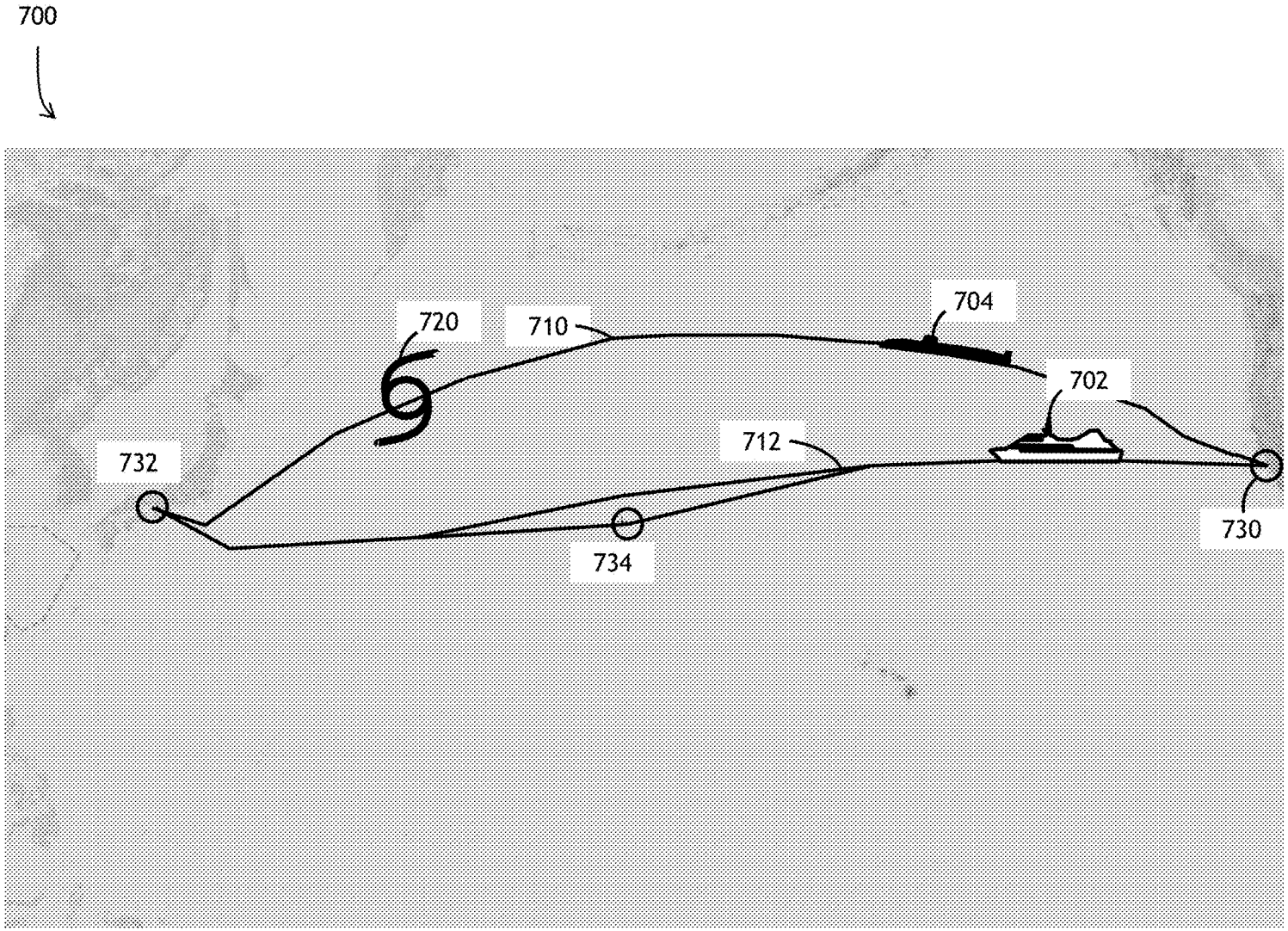
FIG. 7 is an overview of possible oceanic paths made available by one embodiment of the inventive concepts disclosed herein.

Referring to FIG. 7, an overview of possible oceanic paths made available by one embodiment of the inventive concepts disclosed herein is shown. Path diagram 700 may indicate a great circle path 710 as the shortest distance between a departure 730 and a destination 732, but the great circle path 710 may encounter a weather related threat in a typhoon 720 east of the destination 732. In one embodiment, the system 100 may propose an alternate destination 734 to keep the vehicle clear of the typhoon 720.

Here, the system 100 may operate to generate and present to the crewmember an alternate path 712 with may be longer but will mitigate the typhoon threat 720 and allow the vehicle ship 702 or submarine 704 safe passage to the destination 732.

In some embodiments, the system 100 may offer an alternate path 712 based on the type of vehicle 102 is may be assigned to serve. For example, a threat free path for the submarine 704 may be different than a threat free path for the ship 702. As each vehicle 102 may be different and require different parameters in which to operate, so may the system 100 be adaptable to serve a plurality of vehicle types and missions.

CONCLUSION

Noon Specific blocks, sections, devices, functions, processes and modules may have been set forth. However, a skilled technologist will realize that there are many ways to partition the system, and that there are many parts, components, processes, modules or functions that may be substituted for those listed above.

Those having skill in the art will recognize that the state of the art has progressed to the point where there may be little distinction left between hardware, software, and/or firmware implementations of aspects of systems; the use of hardware, software, and/or firmware is generally (but not always, in that in certain contexts the choice between hardware and software can become significant) a design choice representing cost vs. efficiency tradeoffs.

Additionally, implementations of embodiments disclosed herein may include executing a special-purpose instruction sequence or invoking circuitry for enabling, triggering, coordinating, requesting, or otherwise causing one or more occurrences of virtually any functional operations described herein.

While particular aspects of the inventive concepts disclosed herein have been shown and described, it will be apparent to those skilled in the art that, based upon the teachings herein, changes and modifications may be made without departing from the inventive concepts described herein and their broader aspects and, therefore, the appended claims are to encompass within their scope all such changes and modifications as are within the true spirit and scope of the subject matter described herein.

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently.

What is claimed is:

1. A system for alternate threat based path selection, comprising:

at least one processor;

a non-transitory processor-readable memory operatively connected with the at least one processor and storing processor-executable code;

a Flight Management System (FMS) interface operatively connected with the at least one processor and configured for receiving an alternate path selection from the at least one processor and configuring the alternate path selection to be recognizable by a FMS;

wherein the at least one processor is configured for:

receiving threat information associated with a planned path at a specific time, the threat information including at least one threat, the at least one threat including a threat time and a threat boundary for the at least one threat;

receiving the planned path including one or more legs, the planned path from a departure to a destination for a vehicle, each leg of the one or more legs associated with at least two waypoints on the planned path, the planned path further including a planned altitude for each leg, the planned path being part of a filed flight plan which is effective for one half hour prior to planned time of departure and two hours after planned time of departure;

determining an estimated time of arrival (ETA) for each waypoint of the at least two waypoints of each leg on the planned path;

comparing the threat time to the ETA, and comparing the threat boundary to each leg of the one or more legs;

analyzing departure times in five minute increments beginning one half hour prior to planned time of departure and two hours after planned time of departure along with altitudes in one thousand feet increments beginning with 10,000 feet below a cruise altitude through 10,000 feet above the cruise altitude;

determining at least one alternate path for at least one leg of the one or more legs based on the comparing and analyzing, the at least one alternate path including a same path as the planned path with an alternate ETA outside the threat boundary and the threat time for at least one waypoint of the at least two waypoints of each leg and another same path as the planned path with an alternative altitude outside the threat boundary and the threat time for at least one waypoint of the at least two waypoints of each leg;

displaying the at least one alternate path to an operator of the vehicle on a display;

receiving an alternate path selection from the operator; and transmitting the alternate path selection to the FMS interface.

2. The system for alternate threat based path selection of claim 1, wherein the planned altitude for each leg further includes one of: a mean sea level (MSL) altitude, an above ground level (AGL) altitude, a MSL altitude of zero for an entirety of the planned path, an average AGL altitude of zero for the planned path, and an average depth below an ocean surface.

3. The system for alternate threat based path selection of claim 1, wherein the at least one threat further comprises at least one of: a weather related threat, an airspace related threat, a traffic related threat, an operational related threat and a hostile threat to the vehicle.

4. The system for alternate threat based path selection of claim 1, wherein the FMS interface is further configured for receiving the alternate path selection and formatting the alternate path selection to be readable by a path management system in current operation on the vehicle.

5. The system for alternate threat based path selection of claim 1, wherein the system is incorporated within one of: an architecture of an aircraft FMS, a dispatch planning system, and a tactical mission planning system.

6. The system for alternate threat based path selection of claim 1, wherein the threat time for the at least one threat further includes a start time and an end time for the at least one threat and the threat boundary further includes a vertical boundary and a horizontal boundary for the at least one threat.

7. The system for alternate threat based path selection of claim 1, wherein the FMS interface is further configured for sending the alternate path selection to a remote vehicle via a data link.

8. The system for alternate threat based path selection of claim 1, wherein comparing the threat time to the ETA, and comparing the threat boundary to each leg of the one or more legs further includes a per leg comparison of the threat to the planned path.

9. The system for alternate threat based path selection of claim 1, wherein determining at least one alternate path further includes at least one of: an alternate lateral path outside the threat boundary, an alternate vertical path outside the threat boundary, and an alternate destination for the vehicle, each of the alternate lateral path and the alternate vertical path 1) mitigates the at least one threat and 2) creates a minimum distance path from the departure to the destination.

10. The system for alternate threat based path selection of claim 1, wherein the operator of the vehicle is one of: onboard the vehicle and in control of the vehicle, and offboard the vehicle and in remote control of the vehicle.

11. A method for alternate threat based path selection, comprising:

receiving threat information within a threat information module, the threat information associated with a planned path at a specific time, the threat information including at least one threat, the at least one threat including a threat time and a threat boundary for the at least one threat, the threat information module associated with: at least one processor, a non-transitory processor-readable memory operatively connected with the at least one processor and storing processor-executable code, and a Flight Management System (FMS) interface;

receiving the planned path for a vehicle including one or more legs, the planned path from a departure to a destination for the vehicle, each leg of the one or more legs associated with at least two waypoints on the planned path, the planned path further including a planned altitude for each leg, the planned path being part of a filed flight plan which is effective for one half hour prior to planned time of departure and two hours after planned time of departure;

determining an estimated time of arrival (ETA) for each waypoint on the planned path;

comparing the threat time to the ETA, and comparing the threat boundary to each leg of the one or more legs;

analyzing departure times in five minute increments beginning one half hour prior to planned time of departure and two hours after planned time of departure along with altitudes in one thousand feet increments beginning with 10,000 feet below a cruise altitude through 10,000 feet above the cruise altitude;

determining at least one alternate path for at least one leg of the one or more legs based on the comparing and analyzing, the determining via an alternate path selection module, the at least one alternate path including a same path as the planned path with an alternate ETA outside the threat boundary and the threat time for at least one waypoint of the at least two waypoints of each leg and another same path as the planned path with an alternative altitude outside the threat boundary and the threat time for at least one waypoint of the at least two waypoints of each leg;

displaying the at least one alternate path to an operator of the vehicle on a display;

receiving an alternate path selection from the operator;

configuring the alternate path selection to be recognizable by a FMS via the FMS interface; and transmitting the alternate path selection to a FMS onboard the vehicle.

12. The method for alternate threat based path selection of claim 11, wherein the planned altitude for each leg further includes one of: a mean sea level (MSL) altitude, an above ground level (AGL) altitude, a MSL altitude of zero for an entirety of the planned path, an average AGL altitude of zero for the planned path, and an average depth below an ocean surface.

13. The method for alternate threat based path selection of claim 11, wherein the at least one threat further comprises at least one of: a weather related threat, an airspace related threat, a traffic related threat, an operational related threat and a hostile threat to the vehicle.

14. The method for alternate threat based path selection of claim 11, wherein the FMS interface is further configured for receiving the alternate path selection and formatting the alternate path selection to be readable by a path management system in current operation on the vehicle.

15. The method for alternate threat based path selection of claim 11, wherein the system is incorporated within one of: an architecture of an aircraft FMS, a dispatch planning system, and a tactical mission planning system.

16. The method for alternate threat based path selection of claim 11, wherein the threat time for the at least one threat further includes a start time and an end time for the at least one threat and the threat boundary further includes a vertical boundary and a horizontal boundary for the at least one threat.

17. The method for alternate threat based path selection of claim 11, wherein the FMS interface is further configured for sending the alternate path selection to a remote vehicle via a data link.

18. The method for alternate threat based path selection of claim 11, wherein comparing the threat time to the ETA, and comparing the threat boundary to each leg of the one or more legs further includes a per leg comparison of the threat to the planned path.

19. The method for alternate threat based path selection of claim 11, wherein determining at least one alternate path further includes at least one of: an alternate lateral path outside the threat boundary and an alternate vertical path outside the threat boundary, each of the alternate lateral path and the alternate vertical path 1) mitigates the at least one threat and 2) creates a minimum distance path from the departure to the destination.

20. The method for alternate threat based path selection of claim 11, wherein the operator of the vehicle is one of: onboard the vehicle and in control of the vehicle, and offboard the vehicle and in remote control of the vehicle.

21. The method for alternate threat based path selection of claim 11, wherein the at least one alternate path including a same path as the planned path with an alternate ETA outside the threat boundary and the threat time for at least one waypoint of the at least two waypoints of each leg by adjustment of a departure time from at least one waypoint.

* * * * *